US005609124A

United States Patent [19]

Leclerc

[11] Patent Number: 5,609,124

[45] Date of Patent: Mar. 11, 1997

[54] HOT WATER TANK CLEANING DEVICE

[76] Inventor: Jacques Leclerc, 4539 rue Lavoie, Shipshaw, Quebec, Canada, G0V 1V0

[21] Appl. No.: 321,902

[22] Filed: Oct. 12, 1994

Related U.S. Application Data

[63] Continuation of Ser. No. 64,240, May 21, 1993, abandoned.

[51] Int. Cl.[6] ..... F22B 37/48; F28G 9/00

[52] U.S. Cl. ..... 122/388; 122/382; 137/625.2

[58] Field of Search ..... 122/379, 382, 122/388; 137/625.2

[56] References Cited

U.S. PATENT DOCUMENTS

| | | |
|---|---|---|
| 2,407,453 | 9/1946 | Rougier . |
| 2,800,229 | 7/1957 | Spaulding, Jr. . |
| 2,982,307 | 5/1961 | Mueller . |
| 3,211,179 | 10/1965 | Lilly et al. . |
| 3,269,364 | 8/1966 | Higgins . |
| 3,368,683 | 2/1968 | Rak . |
| 3,672,391 | 6/1972 | Livingston et al. . |
| 3,680,531 | 8/1972 | Holdt . |
| 4,090,532 | 5/1978 | Story, Jr. . |
| 4,196,341 | 4/1980 | Williams . |
| 4,479,459 | 10/1984 | Piper ..... 122/388 |
| 4,793,513 | 12/1988 | Verheijen . |

FOREIGN PATENT DOCUMENTS

| | | |
|---|---|---|
| 0084049 | 3/1989 | Japan . |
| 0169201 | 7/1989 | Japan . |
| 0169202 | 7/1989 | Japan . |
| 0169204 | 7/1989 | Japan . |
| 3177749 | 8/1991 | Japan . |
| 4045302 | 2/1992 | Japan . |

*Primary Examiner*—Henry A. Bennett
*Assistant Examiner*—Susanne C. Tinker
*Attorney, Agent, or Firm*—Swabey Ogilvy Renault

[57] ABSTRACT

A cleaning device is proposed for hot water tanks which each include near a bottom end thereof a drain pipe for allowing water contained in the tank to be flushed out therefrom. The present cleaning device comprises a first conduit adapted to be permanently secured to the drain pipe of the tank, a second conduit, such as a garden hose, connected to a sewer or a drain, and a valve mounted between the first and second conduits for controlling the flow therethrough and thus the flushing of the water and of the impurities and residues contained in the tank. The valve is preferably of the motorized type and is actuated by a programmable timer in order that the tank can be automatically and periodically flushed without intervention from the user.

20 Claims, 1 Drawing Sheet

T
10
20
22
18

34
16
14
12
12
10
W
18
22
20
D
32
24
26
28
30

T

HOT WATER TANK CLEANING DEVICE

This application is a continuation of application Ser. No. 08/064,240, filed on May 21, 1993, now abandoned.

BACKGROUND OF THE INVENTION

1. Field of the Invention

The present invention relates to hot water tanks and, more particularly, to a device for cleaning hot water tanks.

2. Description of the Prior Art

In a standard hot water tank where the bottom six to eight inches contain water which is at most lukewarm, there is always a heavy concentration of, impurities and residues. These impurities may be removed by connecting a hose to a drainage valve threaded to a bottom end of the sidewall of the hot water tank for allowing fluid flow between the inside and the outside of the hot water tank. Then, the electrical power to the heating elements is cut off as well as the city main water inlet to the water tank. Then, a hot water faucet is opened as well as the drainage valve. Accordingly, water in the tank will flow, under the forces of gravity, through the valve and the hose towards a sewage, or the like. The hot water faucet is opened in order to provide an air flow in the tank. The emptying of the tank can take up to one hour and a half for a sixty gallon water tank. Then, it is preferable to open the water inlet to the tank for thoroughly rinsing the tank. Thereafter, the valve is closed and the tank is filled with city water, with the electrical power being restored to the heating elements of the hot-water tank. In practice, this method is complicated and is more or less satisfactory since the valve does not allow for most of the impurities, i.e. the larger impurities or residues, to be flushed out.

SUMMARY OF THE INVENTION

It is therefore an aim of the present invention to provide an improved device for cleaning hot water tanks.

It is also an aim of the present invention to provide a hot water tank cleaning device adapted for periodically and automatically cleaning by flushing a hot water tank.

Therefore, in accordance with the present invention, there is provided a device for cleaning hot water tanks of the type each including a drain outlet at a bottom end thereof in flow communication with water contained in the tank and also including a cold water inlet and a hot water outlet. The device comprises a conduit means having first and second ends, a valve means on the conduit means intermediate the first and second ends thereof, and attachment means for securing a first end of the conduit means to the drain outlet of the tank, whereby, when the valve means is opened, at least some of the water and of the impurities contained in the tank are flushed out of the tank through the drain outlet thereof, through the conduit means and the valve means and out of the second end of the conduit means for appropriate disposal thereof.

Also in accordance with the present invention, there is provided a method for cleaning a hot water tank of the type including a drain outlet at a bottom end thereof in flow communication with water contained in the tank and also including a cold water inlet and a hot water outlet. The method comprises the steps of securing to the drain outlet a first end of a conduit means having also a second end and a valve means provided thereon intermediate the first and second ends thereof; opening the valve means for causing at least some of the water and of the impurities contained in the tank to be flushed out of the tank through the drain outlet thereof, through the conduit means and the valve means and out of the second end of the conduit means for appropriate disposal thereof.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figures 1, 2:
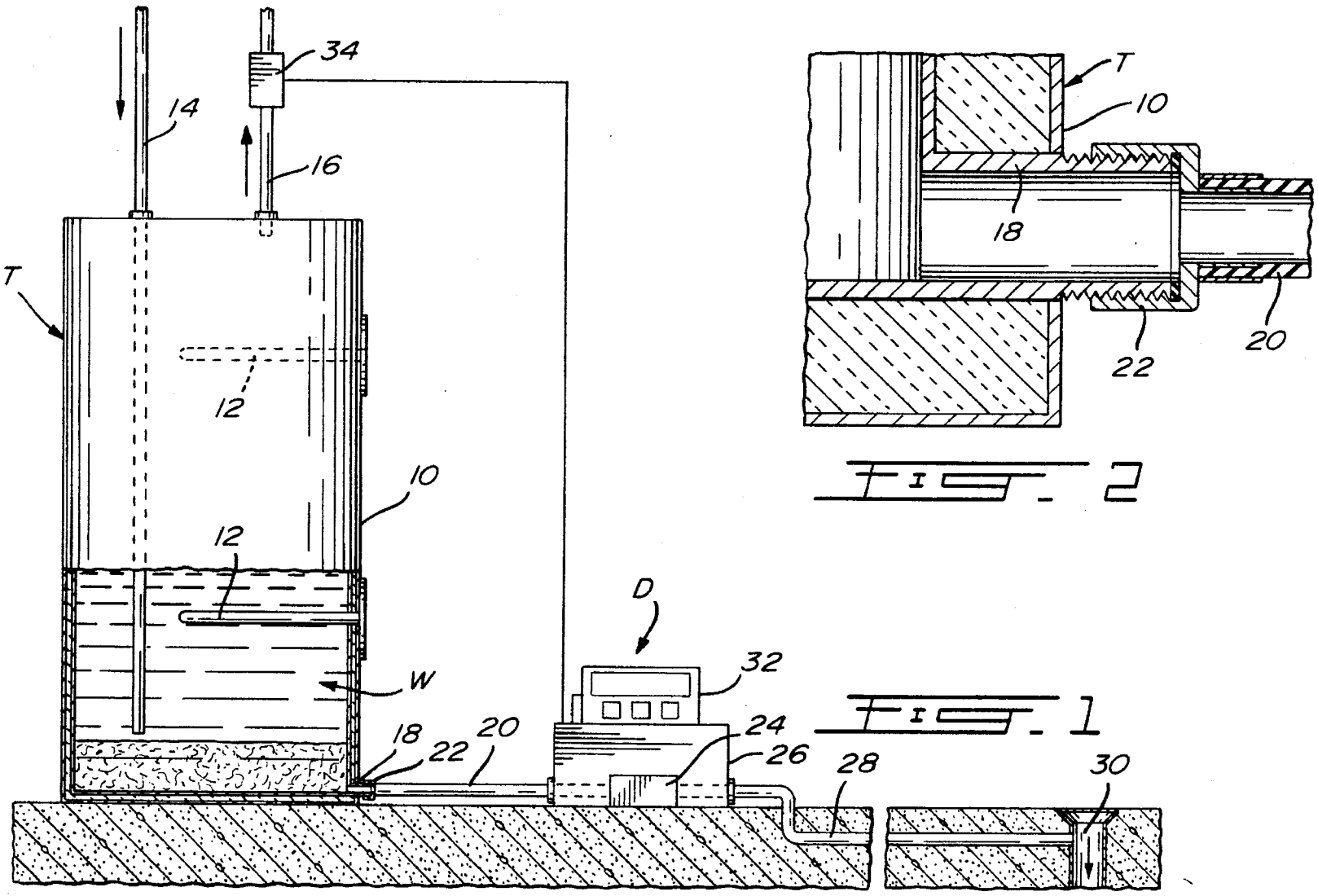
FIG. 1 is a fragmentary elevational view partly in cross-section of a cleaning device in accordance with the present invention adapted to a hot water tank.
FIG. 2 is an enlarged cross-sectional view of the connection of the cleaning device of the present invention to the hot water tank.

In accordance with the present invention, FIG. 1 illustrates a cleaning device D adapted to a hot water tank T, such as those used domestically. The tank T comprises a double-walled insulated cylindrical shell 10 with a pair of spaced apart heating elements 12 extending diametrically therein. The tank T is adapted for containing therein water W which is heated by the heating elements 12. Generally, water is supplied to the tank T at city pressure by way of cold water main inlet pipe 14 which delivers the water close to the bottom of the tank T. When hot water is required from the tank, such as when a hot water tap is opened, hot water is supplied from the hot water tank T to the hot water distribution pipe network of the house by way of outlet pipe 16. The hot water tank T includes near the bottom thereof a drain pipe 18 fixedly mounted to the shell 10 and extending therethrough for providing fluid communication between the inside and the outside of the tank T. The drain pipe 18 defines an outer thread at a free end thereof extending outside of the tank T. In standard applications, a valve is mounted inside the drain pipe 18 by way of an outside sleeve thereof which defines an inner thread adapted to threadably engage the outer thread of the drain pipe 18. The flow opening of such a valve located within the drain pipe 18 is relatively small and thus restricts considerably the size of the impurities capable of passing therethrough when it is desired to drain the hot water tank T.

As seen in FIG. 1, the bottom portion of the water W contained in the hot water tank T (approximately the bottom six to eight inches thereof) is concentrated with impurities and it is therefore suggested to drain periodically the hot water tank in order to remove therefrom the water which is overly concentrated in impurities. With the aforementioned prior art valve, it is necessary to first shut off the electrical power to the heating elements 12 and to shut off the water supplied to the tank T by way of the inlet pipe 14. A hose is then connected to the valve and, after a hot water tap has been opened, the valve is opened for allowing fluid flow therethrough from the tank to the hose towards a drain or a sewer. As the water supply from the city has been interrupted, the emptying of the tank takes place under the forces of gravity.

Accordingly, the cleaning device of the present invention comprises a first conduit 20 permanently mounted to the drain pipe 18 by way of a coupling 22 threadably engaged to the drain pipe 18. The first conduit 20 is connected at its other end to an inlet of a valve 24, such as a ball valve, located in a housing 26. A second conduit 28, such as a garden hose, is connected to the outlet of the valve 24 for carrying the water drained from the hot water tank T towards a sewer or a drain 30. The valve 24 illustrated in FIG. 1 is of the motorized type, with the actuation thereof being controlled by a programmable timer 32 which can be adjusted by the user in order that the hot water tank T be drained at selected intervals of time. The timer 32 also operates an outlet valve 34 provided on the hot water outlet pipe 16, whereby, when the ball valve 24 is opened for allowing the hot water tank to be flushed, the outlet valve 34 is closed for preventing water from escaping from the tank T by way of the outlet pipe 16 and causing the heating elements from continuously trying to heat the cold water continuously delivered to the tank T by the inlet pipe 14 and flushed therefrom through the drain pipe 18 during the whole tank cleaning operation. By way of the timer 22, the user can also select the length of the draining process. The motorized valve 24 and the timer 32 are electrically connected to a standard domestic 110-volt outlet.

Therefore, the prior art valve has been replaced by a permanently mounted hose along which there is provided a ball valve which is operated by a timer, such as at regular intervals, with the system communicating directly with a drain or a sewer.

With the cleaning device D of the present invention, the hot water tank T can be periodically drained or flushed in such a way as to prevent an unsafe accumulation of deposits at the bottom thereof. The flow opening of the present cleaning device D is substantially larger than that offered by the prior art valve thereby allowing for bigger impurities to be removed from the hot water tank T. Furthermore, with a proper periodic drainage of the hot water tank T with the cleaning device D of the present invention, substantially no deposits are allowed to be formed which could be of dimensions preventing the removal thereof from the tank T by way of the present cleaning device D. For example, the inside diameter of the drain pipe 18 is normally 0.375 inch with the inside diameter of the first and second conduits 20 and 28 being 0.50 inch for a garden hose.

It is noted that, with the present invention, the water will be flushed out of the hot water tank T in accordance with the pressure of the city water supplied through inlet pipe 14 instead of simply being flushed out under gravity as it is the case for the above-described prior art valve.

It is also noted that the housing 26 and the valve 24 and timer 32 associated therewith can be mounted on top or on the side of the shell 10 of the hot water tank T.

In operation, the timer 32 will produce a signal which will cause the motorized valve 24 to open with a further signal being emitted substantially simultaneously for closing the hot water outlet valve 34. With assistance from the pressure of the cold water being supplied to the tank T by way of the water main or inlet pipe 14, the water W contained in the tank T will be flushed out of the tank T through the drain pipe 18, the first conduit 20, the open motorized valve 24 and the second conduit 28 towards the sewer or drain 30. Again, the user can set the programmable timer 32 for controlling the cleaning of the tank T at set intervals and for a predetermined amount of time. The timer 32 is normally located in the housing 26 with the controls therefor being provided on the housing 26 for easy adjustment thereof.

It is noted that the drain pipe 18 is already provided on hot water tanks for allowing the drainage thereof by way of gravity. The cold water supplied through the inlet pipe 14 is fed under the city water main pressure which can vary approximately between 60 and 75 psi. Accordingly, the first conduit 20 must be able to withhold pressures of up to 75 psi. The motorized valve 24 can reduce the pressure to 7 to 8 psi. For illustration purposes, the temperature of the water W located at the bottom of the tank has a temperature of approximately 75° F. with the hot water W located thereabove and fed through the outlet pipe 16 having a temperature of approximately 140° F.

In summary, the cleaning device D of the present invention provides for an easy and periodical cleaning of a hot water tank T generally without intervention from the user, asides from the installation of the device D to the hot water tank T and the subsequent programming of the timer 32. With the present cleaning device D, the concentration of impurities or residues in the tank T is greatly reduced thereby increasing the purity of the hot water supplied by the tank through the outlet pipe 16. Accordingly, the present cleaning device D also represents an improvement of significance with regards to the health of the users, especially since the Legionnaire's decease has been linked to the concentrated presence of impurities at the bottom of hot water tanks.

I claim:

1. A device for cleaning hot water tanks of a type each including a drain outlet at a bottom end thereof in flow communication with water contained in the tank and also including a cold water inlet and a hot water outlet, the cold water inlet continuously supplying pressurized water to the tank, said device comprising a conduit means having first and second ends, a valve means on said conduit means intermediate said first and second ends thereof, said first end of said conduit means being connected to the drain outlet of the tank, whereby, when said valve means is opened, at least some of the water and impurities contained in the tank are flushed out of the tank through the drain outlet thereof at least partly under a pressure of the supply water continuously fed to the tank by way of the cold water inlet, said at least some water and impurities exiting the tank through the drain outlet then passing through said conduit means and said valve means and out of said second end of said conduit means for appropriate disposal thereof.

2. A device as defined in claim 1, wherein said valve means comprise a motorized valve means controlled by a valve control means.

3. A device as defined in claim 2, wherein said valve means comprise an electrically actuated valve, and wherein said valve control means comprises a programmable timer for opening said valve at pre-selected intervals and for a predetermined amount of time.

4. A device as defined in claim 3, wherein said valve and said programmable timer are encased in a housing means with controls for said programmable timer being accessible from outside of said housing means.

5. A device as defined in claim 3, wherein said valve is a ball valve.

6. A device as defined in claim 3, wherein said conduit means comprise first and second conduits, said first conduit extending between the drain outlet and an inlet opening of said valve, said second conduit extending from an outlet of said valve.

7. A device as defined in claim 6, wherein a coupling means is provided for connecting said first conduit to the drain outlet.

8. A device as defined in claim 7, wherein the tank comprises at the drain outlet thereof a drain pipe, the drain pipe defining an outer thread at an end thereof located outside of the tank, said coupling means defining an inner thread adapted to engaging the outer thread of the drain pipe for securing said first conduit to the tank.

9. A device as defined in claim 2, wherein an electric hot water outlet valve is provided on a hot water outlet pipe extending from the hot water outlet of the tank, said electric outlet valve being adapted to displace to a closed position thereof substantially when said motorized valve means is opened.

10. A device as defined in claim 6, wherein said second conduit means comprises a hose.

11. A method for cleaning a hot water tank of a type including a drain outlet at a bottom end thereof in flow communication with water contained in the tank and also including a cold water inlet and a hot water outlet, the cold water inlet continuously supplying pressurized water to the tank, the method comprising the steps of securing to the drain outlet a first end of a conduit means having also a second end and a valve means provided thereon intermediate said first and second ends thereof; opening said valve means for causing at least some of the water and impurities contained in the tank to be flushed out of the tank through the drain outlet thereof, through said conduit means and said valve means and out of said second end of said conduit means for appropriate disposal thereof, the water and the impurities exiting the tank at least partly under a pressure of the supply water continuously fed to the tank by way of the cold water inlet.

12. A method as defined in claim 11, wherein said valve means comprise a motorized valve means controlled by a valve control means, and wherein an electric hot water outlet valve is provided on a hot water outlet pipe extending from the water outlet of the tank, said electric outlet valve being adapted to displace to a closed position thereof substantially when said motorized valve means is opened, said method including the step of automatically opening said valve means and closing said outlet valve for flushing at least some of the water and of the impurities contained in the tank.

13. A hot water tank comprising a drain outlet at a bottom end thereof in flow communication with water contained in the tank and also including a cold water inlet and a hot water outlet, the cold water inlet continuously supplying pressurized water to the tank, said tank also comprising a conduit means having first and second ends, a valve means on said conduit means intermediate said first and second ends thereof, said first end of said conduit means being connected to the drain outlet of the tank, whereby, when said valve means is opened, at least some of the water and impurities contained in the tank are flushed out of the tank through the drain outlet thereof at least partly under a pressure of the supply water continuously fed to said tank by way of said cold water inlet, the water and impurities exiting said tank through said drain outlet then passing through said conduit means and said valve means and out of said second end of said conduit means for appropriate disposal thereof.

14. A hot water tank as defined in claim 13, wherein said valve means comprise a motorized valve means controlled by a valve control means.

15. A hot water tank as defined in claim 14, wherein said valve means comprise an electrically actuated valve, and wherein said valve control means comprises a programmable timer for opening said valve at pre-selected intervals and for a predetermined amount of time.

16. A hot water tank as defined in claim 15, wherein said valve and said programmable timer are encased in a housing means with controls for said programmable timer being accessible from outside of said housing means.

17. A hot water tank as defined in claim 14, wherein said conduit means comprise first and second conduits, said first conduit extending between the drain outlet and an inlet opening of said valve, said second conduit extending from an outlet of said valve.

18. A hot water tank as defined in claim 17, wherein a coupling means is provided for connecting said first conduit to the drain outlet, and wherein said tank comprises at the drain outlet thereof a drain pipe, said drain pipe defining an outer thread at an end thereof located outside of the tank, said coupling means defining an inner thread engaging said outer thread of said drain pipe for securing said first conduit to said tank.

19. A hot water tank as defined in claim 14 wherein an electric hot water outlet valve is provided on a hot water outlet pipe extending from said hot water outlet of said tank, said electric outlet valve being adapted to displace to a closed position thereof substantially when said motorized valve means is opened.

20. A device as defined in claim 17, wherein said second conduit means comprises a hose.

* * * * *